US011992176B2

(12) United States Patent
So et al.

(10) Patent No.: US 11,992,176 B2
(45) Date of Patent: May 28, 2024

(54) CLEANER AND CONTROL METHOD THEREOF

(71) Applicant: Samsung Electronics Co., Ltd., Suwon-si (KR)

(72) Inventors: Jeayun So, Suwon-si (KR); Jinhee Kim, Suwon-si (KR); Jihye Seo, Suwon-si (KR); Yeonkyu Jeong, Suwon-si (KR); Jaeyoul Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 429 days.

(21) Appl. No.: 17/012,519

(22) Filed: Sep. 4, 2020

(65) Prior Publication Data

US 2021/0068604 A1 Mar. 11, 2021

(30) Foreign Application Priority Data

Sep. 6, 2019 (KR) ..... 10-2019-0111003

(51) Int. Cl.
*A47L 9/28* (2006.01)
*A47L 9/19* (2006.01)

(52) U.S. Cl.
CPC ..... *A47L 9/2815* (2013.01); *A47L 9/19* (2013.01); *A47L 9/2842* (2013.01); *A47L 2201/024* (2013.01); *A47L 2201/06* (2013.01)

(58) Field of Classification Search
CPC ..... A47L 9/2815; A47L 9/281; A47L 9/2842
See application file for complete search history.

(56) References Cited

U.S. PATENT DOCUMENTS 4,920,605 A 5/1990 Takashima
4,937,912 A 7/1990 Kurz
5,136,750 A 8/1992 Takashima et al.
(Continued)

FOREIGN PATENT DOCUMENTS

DE 10 2007 036 170 A1 2/2009
DE 10 2007 036 170 A1 2/2009
(Continued)

OTHER PUBLICATIONS

International Search Report dated Dec. 4, 2020, in corresponding International Application No. PCT/KR2020/011934.
(Continued)

*Primary Examiner* — Bryan R Muller
(74) *Attorney, Agent, or Firm* — STAAS & HALSEY LLP

(57) ABSTRACT

Disclosed is a cleaner. The cleaner according to an embodiment includes a main body, a suction device configured to suck dust outside the cleaner, a dust detection sensor including a light emitting element and a light receiving element disposed adjacent to the suction device, a dust container configured to store sucked dust through the suction device, and a processor configured to identify a dust inflow state and a dust amount of the dust container based on a voltage value output from the light receiving element, and control an operation of the cleaner based on the identified dust inflow state and dust amount, wherein the light emitting element and the light receiving element are disposed at an outside of the dust container in a direction toward an inlet of the dust container.

20 Claims, 11 Drawing Sheets

(56) References Cited

U.S. PATENT DOCUMENTS

| | | | | |
|---|---|---|---|---|
| 5,144,715 | A | 9/1992 | Matsuyo et al. | |
| 5,163,202 | A * | 11/1992 | Kawakami | A47L 9/2815 356/438 |
| 5,182,833 | A * | 2/1993 | Yamaguchi | A47L 9/2842 15/319 |
| 5,233,682 | A | 8/1993 | Abe et al. | |
| 5,319,827 | A | 6/1994 | Yang | |
| 5,404,612 | A | 4/1995 | Ishikawa | |
| 5,542,146 | A | 8/1996 | Hoekstra et al. | |
| 5,815,884 | A | 10/1998 | Imamura et al. | |
| 6,023,814 | A | 2/2000 | Imamura | |
| 6,029,309 | A | 2/2000 | Imamura | |
| 6,859,010 | B2 | 2/2005 | Jeon et al. | |
| 7,562,414 | B2 | 7/2009 | Oh et al. | |
| 8,172,932 | B2 | 5/2012 | Oh et al. | |
| 8,742,926 | B2 | 6/2014 | Schnittman et al. | |
| 8,756,751 | B2 * | 6/2014 | Jung | A47L 9/2815 15/319 |
| 8,776,307 | B2 | 7/2014 | Schulz et al. | |
| 8,972,061 | B2 | 3/2015 | Rosenstein et al. | |
| 9,027,199 | B2 | 5/2015 | Jung et al. | |
| 9,186,030 | B2 | 11/2015 | Jung et al. | |
| 9,233,471 | B2 | 1/2016 | Schnittman et al. | |
| 9,408,515 | B2 | 8/2016 | Rosenstein et al. | |
| 9,723,962 | B2 | 8/2017 | Yoon et al. | |
| 9,826,872 | B2 | 11/2017 | Schnittman et al. | |
| 10,028,631 | B2 | 7/2018 | Jung et al. | |
| 2004/0178767 | A1 | 9/2004 | Jeon et al. | |
| 2005/0171644 | A1 * | 8/2005 | Tani | A47L 9/2826 701/25 |
| 2007/0214597 | A1 | 9/2007 | Suzuki | |
| 2012/0011676 | A1 | 1/2012 | Jung | |
| 2012/0011677 | A1 | 1/2012 | Jung et al. | |
| 2012/0013907 | A1 | 1/2012 | Jung et al. | |
| 2012/0169497 | A1 * | 7/2012 | Schnittman | G01V 8/20 340/540 |
| 2016/0029865 | A1 | 2/2016 | Jung et al. | |
| 2017/0215670 | A1 | 8/2017 | Heo et al. | |
| 2018/0199784 | A1 | 7/2018 | Schnittman et al. | |
| 2018/0296051 | A1 | 10/2018 | Jung et al. | |

FOREIGN PATENT DOCUMENTS

| | | | |
|---|---|---|---|
| EP | 0 327 936 | B1 | 9/1993 |
| EP | 0 372 903 | B1 | 2/1994 |
| EP | 0 451 787 | B1 | 3/1995 |
| EP | 0 413 359 | B1 | 11/1995 |
| EP | 0 845 237 | B1 | 4/2000 |
| EP | 0 904 723 | B1 | 8/2001 |
| EP | 0 861 629 | B1 | 9/2001 |
| EP | 0 870 462 | B1 | 10/2001 |
| EP | 1 980 189 | A2 | 10/2008 |
| EP | 1 836 941 | B1 | 2/2014 |
| JP | 10-94499 | A | 4/1998 |
| JP | 2005-211495 | A | 8/2005 |
| KR | 10-1993-0008368 | B1 | 8/1993 |
| KR | 10-1993-0008369 | B1 | 8/1993 |
| KR | 10-1996-005005 | B1 | 4/1996 |
| KR | 10-1996-0005008 | B1 | 4/1996 |
| KR | 10-1997-0000584 | B1 | 1/1997 |
| KR | 10-1997-0005516 | B1 | 4/1997 |
| KR | 10-0136755 | B1 | 1/1998 |
| KR | 10-1998-0008152 | A | 4/1998 |
| KR | 10-0136681 | B1 | 4/1998 |
| KR | 10-0150772 | B1 | 10/1998 |
| KR | 10-1999-0018818 | A | 3/1999 |
| KR | 10-0263774 | B1 | 11/2000 |
| KR | 20-0182561 | Y1 | 12/2000 |
| KR | 10-0492590 | B1 | 6/2005 |
| KR | 10-0679893 | B1 | 2/2007 |
| KR | 10-2008-0092063 | A | 10/2008 |
| KR | 10-2011-0010359 | A | 2/2011 |
| KR | 10-1103910 | B1 | 1/2012 |
| KR | 10-2012-0035519 | A | 4/2012 |
| KR | 10-2012-0100682 | | 9/2012 |
| KR | 10-1273766 | B1 | 6/2013 |
| KR | 10-1452212 | B1 | 10/2014 |
| KR | 10-1483541 | | 1/2015 |
| KR | 10-2016-0040746 | A | 4/2015 |
| KR | 10-1880087 | B1 | 7/2018 |
| WO | WO 01/08544 | A1 | 2/2001 |

OTHER PUBLICATIONS

Written Opinion of the International Searching Authority dated Dec. 4, 2020, in corresponding International Application No. PCT/KR2020/011934.

Extended European Search Report dated Jul. 1, 2022, issued by the European Patent Office for European Patent Application No. 20859895.3.

Extended European Search Report dated Jul. 1, 2022, issued by the European Patent Office for European Patent Application No. 20859895.3.

Office Action dated Apr. 12, 2024, in Korean Patent Application No. 10-2019-0111003.

* cited by examiner

100

CLEANER AND CONTROL METHOD THEREOF

CROSS-REFERENCE TO RELATED APPLICATION

This application is based on and claims priority under 35 U.S.C. § 119 to Korean Patent Application No. 10-2019-0111003, filed on Sep. 6, 2019, in the Korean Intellectual Property Office, the disclosure of which is incorporated by reference herein in its entirety.

BACKGROUND

1. Field

Example embodiments of the disclosure relate to a cleaner and a method for controlling thereof and, more particularly, to a cleaner for identifying whether dust is sucked and an amount of dust in a dust container using one sensor and a method for controlling thereof.

2. Description of Related Art

A cleaner is a device for sucking dust existing on an outside the cleaner and removing the outside dust. The cleaner may increase the suction force of the cleaner when the dust flowing into a suction port of the cleaner is detected, and may inform a user of a status of the dust container when the dust container is filled with dust. For this purpose, the cleaner requires a plurality of sensors such as a sensor for detecting dust flowing into the suction port, a sensor for detecting the amount of dust in the dust container, or the like.

A piezo sensor used as a dust inflow detection sensor may have a drawback in that only a large foreign substance is detectable, and a small foreign substance such as dust is not easily detectable and thus, an infrared sensor is used as a dust inflow detection sensor. In a case of an opposed type infrared sensor where a transmitting element and a receiving element face each other, it is difficult to detect dust except for a field of view (FOV) region of the transmitting/receiving element, and there is a drawback in that a dead zone in which dust is not detected is wide.

A sensor for detecting the amount of dust in the dust container is mainly installed as an opposed-type infrared sensor in the dust container. The dust amount detection sensor may detect the fullness of the dust container, as dust is accumulated to cause light emitting and receiving to be blocked. However, such a dust amount detection sensor has a problem in that it is difficult to properly detect the amount of dust when the light emitting/light receiving portion of the light emitting sensor and the light receiving sensor in the dust container are contaminated.

In addition, there is a problem in that a plurality of sensors such as a dust detection sensor and a dust amount detection sensor are installed, so that a manufacturing cost of the cleaner increases, or a plurality of sensors occupy a lot of space in the cleaner so that the size and volume of the cleaner increase.

SUMMARY

Example embodiments of the disclosure address at least the above-mentioned problems and/or disadvantages and provide at least the advantages described below.

Provided is a cleaner for identifying whether dust flows into a cleaner and a dust amount in a dust container using one sensor and a method for providing thereof.

In accordance with an aspect of the disclosure, a cleaner according to an embodiment includes a main body, a suction device configured to suck dust outside the cleaner, a dust detection sensor including a light emitting element and a light receiving element disposed adjacent to the suction device, a dust container configured to store sucked dust through the suction device, and a processor configured to identify a dust inflow state and a dust amount of the dust container based on a voltage value output from the light receiving element, and control an operation of the cleaner based on the identified dust inflow state and dust amount, wherein the light emitting element and the light receiving element are disposed at an outside of the dust container in a direction toward an inlet of the dust container.

According to an embodiment, a method of controlling a cleaner includes sucking dust outside the cleaner; emitting light at an outside of a dust container included in the cleaner in a direction of an inlet of the dust container using a light emitting element; detecting a light amount of light using a light receiving element; identifying a dust inflow state and a dust amount in the dust container based on a voltage value output from the light receiving element, in correspondence to the detected light amount; and controlling an operation of the cleaner based on the identified dust inflow state and the dust amount.

BRIEF DESCRIPTION OF THE DRAWINGS

The above and/or other aspects, features, and advantages of certain embodiments of the disclosure will be more apparent from the following detailed description, taken in conjunction with the accompanying drawings, in which.

DETAILED DESCRIPTION

Figure 1A:
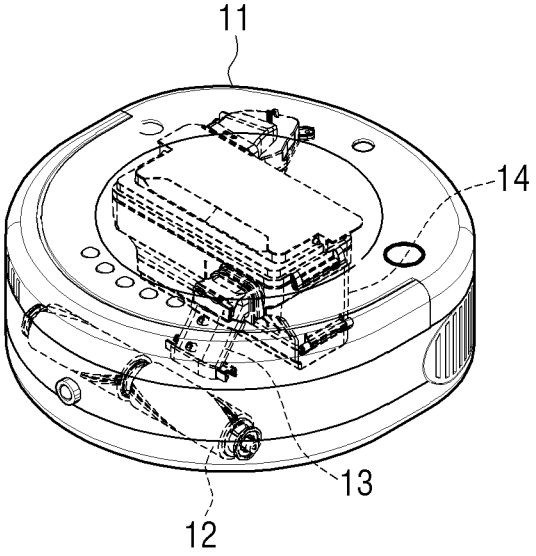
FIG. 1A is a diagram illustrating a cleaner according to an embodiment.

Various example embodiments of the disclosure will be described with reference to the accompanying drawings. However, it may be understood that the disclosure is not limited to the embodiments described hereinafter, but also includes various modifications, equivalents, and/or alternatives of these embodiments. In relation to explanation of the drawings, similar drawing reference numerals may be used for similar constituent elements.

In this specification, expressions such as "have," "may have," "include," "may include" or the like represent presence of a corresponding feature (for example, components such as numbers, functions, operations, or parts) and does not exclude the presence of additional feature.

In this document, the expressions "A or B," "at least one of A and/or B," or "one or more of A and/or B," and the like include all possible combinations of the listed items. For example, "A or B," "at least one of A and B," or "at least one of A or B" includes (1) at least one A, (2) at least one B, (3) at least one A and at least one B all together.

As used herein, the terms "first," "second," or the like may denote various components, regardless of order and/or importance, and may be used to distinguish one component from another, and does not otherwise limit the components.

It is to be understood that an element (e.g., a first element) is "operatively or communicatively coupled with/to" another element (e.g., a second element) is that any such element may be directly connected to the other element or may be connected via another element (e.g., a third element). On the other hand, when an element (e.g., a first element) is "directly connected" or "directly accessed" to another element (e.g., a second element), it can be understood that there is no other element (e.g., a third element) between the other elements.

The expression "configured to" can be used interchangeably with, for example, "suitable for," "having the capacity to," "designed to," "adapted to," "made to," or "capable of." The expression "configured to" does not necessarily mean "specifically designed to" in a hardware sense. Instead, under some circumstances, "a device configured to" may indicate that such a device "can perform ~" along with another device or part. For example, the expression "a processor configured (or set) to perform A, B, and C" may indicate an exclusive processor (e.g., an embedded processor) to perform the corresponding action, or a generic-purpose processor (e.g., a central processing unit (CPU) or application processor (AP)) that can perform the corresponding actions by executing one or more software programs stored in the memory device.

In the disclosure, the cleaner is a device for sucking external dust or foreign substances in a manner of sucking air and can include a vacuum cleaner, a stand-type vacuum cleaner, a handy vacuum cleaner, a robot cleaner, a cyclone cleaner, or the like.

In the disclosure, dust refers to foreign substances outside the cleaner, and includes large foreign materials such as sand, hair, and the like, as well as fine particles floating in the air.

Hereinafter, with reference to the attached drawings, embodiments will be described in detail.

Figure 1B:
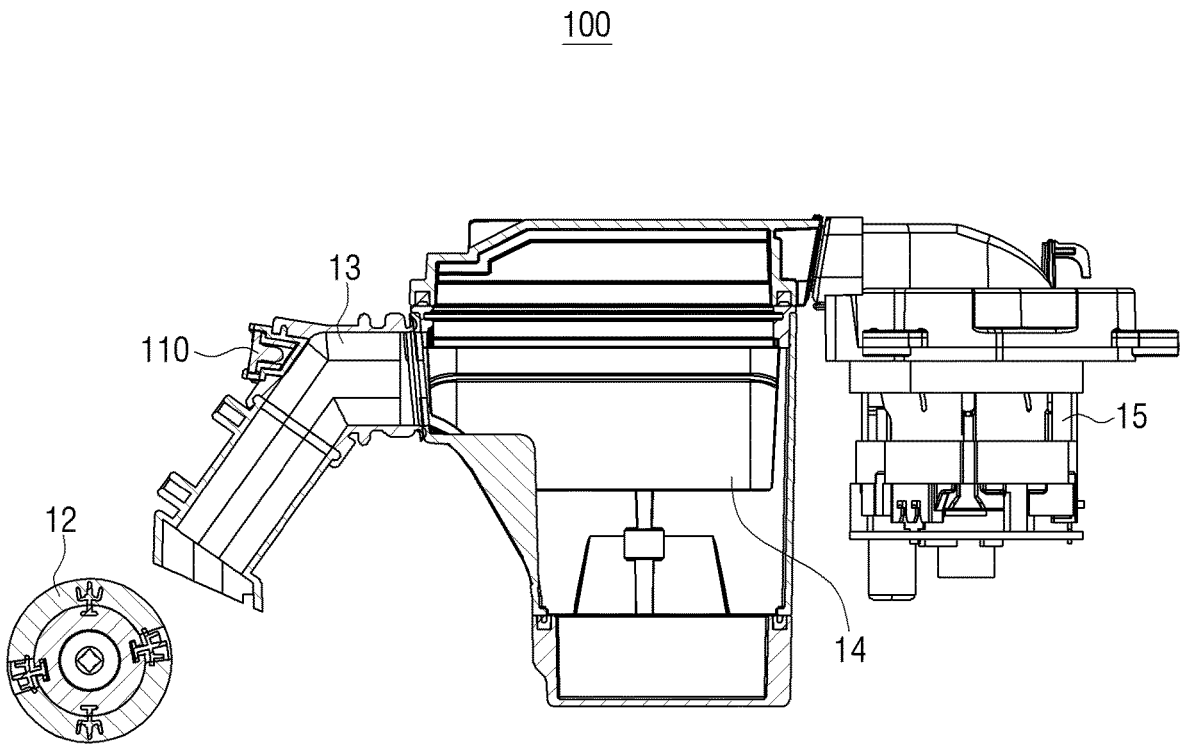
FIG. 1B is a diagram illustrating a cleaner according to an embodiment.

FIG. 1A is a diagram illustrating a cleaner according to an embodiment. To be specific, FIG. 1A is a perspective view illustrating a cleaner according to an embodiment, and FIG. 1B is a diagram illustrating an element included in a cleaner according to an embodiment.

Referring to FIG. 1A, a cleaner 100 may include a main body 11, a brush 12, a suction device 13, and a dust container 14.

The main body 11 may have a variety of shapes. Although FIG. 1A illustrates a circular robot cleaner, the cleaner of the disclosure can be variously implemented with a vacuum cleaner, a stand-type vacuum cleaner, a handy vacuum cleaner, a robot cleaner, a cyclone cleaner, or the like, and thus, the main body can be variously formed of a square, a rectangular parallelepiped, a cylindrical shape, or the like.

The main body 11 can form a suction port in one side of the main body 11 to suck foreign substances outside the cleaner 100 into the cleaner 100. In the disclosure, a suction port is provided at a lower portion of the main body, but is not necessarily limited thereto, and the position of the suction port may vary depending on the type and shape of the cleaner.

In the suction port, the brush 12 for removing foreign substances or dust of a bottom surface of the cleaner may be provided in or connected to the suction port. When the brush 12 is connected to the suction port, the brush 12 may be connected to the suction port through an extension member (not shown), a handle device (not shown), or the like.

This is merely exemplary, and the suction port of the main body may be connected to the suction device 13 and the suction device may include a brush.

FIG. 1B is a diagram illustrating an element included in a cleaner according to an embodiment.

The brush 12 sweeps out dust outside the cleaner. The brush 12 may be rotated by a motor to guide dust or foreign substances on the bottom surface of the cleaner toward the suction port of the cleaner 100. The dust or foreign substances flowed into the suction port by the brush 12 may be sucked into the cleaner 100 and collected in the dust container 14 through the suction device 13.

The brush 12 may include a side brush. In particular, in the case where the cleaner 100 is a robot cleaner, a side brush (not shown) can be included in addition to the brush 12, and the side brush (not shown) can collect the dust on the floor and send the collected dust to the main brush close to the suction flow path. The side brush (not shown) may be driven by a motor separate from the motor of the brush 12.

The suction device 13 is configured to suck dust outside the cleaner 100. The suction device 13 may suck dust outside the cleaner along with air outside the cleaner.

The suction device 13 may be connected to a suction port of the cleaner 100. The suction device 13 may include a suction flow path, and dust passing through the suction flow path may be stored in the dust container 14. That is, the suction device 13 may connect the suction port of the main body 11 with the dust container 14, so that the dust sucked through the suction port is stored in the dust container 14. In that the dust is moved from the suction port to the dust container 14 through the suction device 13, a dust detection sensor 110 for detecting the inflow of dust into a position adjacent to the suction device 13 may be provided.

The dust container 14 can be installed at the rear of the main body 11. The dust container 14 may store dust sucked by the cleaner 100, and if the amount of dust or foreign substances stored in the dust container 14 exceeds a predetermined value, the cleaner 100 may display a notification indicating that the dust container is full. Further, when the cleaner 100 is a robot cleaner, if the amount of dust or foreign substances stored in the dust container 14 exceeds a predetermined value, the cleaner 100 can move to a docking station (not shown) for docking. The dust or foreign substances collected in the dust container 14 may be sucked into the dust container in the docking station (not shown). Alternatively, the foreign substance or dust collected in the dust container can be removed by detaching the dust container for throwing out dust or replacing the dust container.

A suction motor 15 generates a suction force so that dust outside the cleaner is absorbed into the dust container 14. Specifically, the suction motor 15 may transfer the rotational force of the suction motor 15 to a dust suction fan (not shown) to rotate the dust suction fan (not shown). Air outside the cleaner is flowed into the suction device 13 along with dust from the outside of the cleaner by a dust suction fan.

The suction motor 15 can vary the intensity of the suction force according to whether the dust is detected. The suction motor 15 may be operated in a normal mode while the dust is not detected, so that a suction force of a predetermined size can be generated. When the dust is detected, the suction motor 15 may be operated in a turbo mode so that a suction force greater than or equal to a predetermined size in the normal mode can be generated.

The dust detection sensor 110 may be used to detect the amount of dust in the dust container 14, as well as the inflow of dust. For this purpose, the dust detection sensor 110 may be provided outside the dust container 14, and can be disposed in a direction of an inlet of the dust container at the outside of the dust container 14.

The cleaner 100 according to the disclosure will be described in greater detail.

Figure 2:
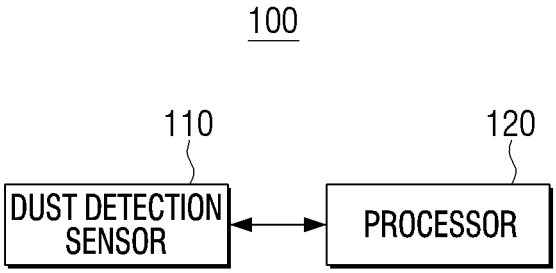
FIG. 2 is a block diagram illustrating a configuration of a cleaner according to various embodiments.

FIG. 2 is a block diagram illustrating a configuration of a cleaner according to various embodiments.

As illustrated in FIG. 2, the cleaner 100 includes the dust detection sensor 110 and a processor 120.

The dust detection sensor 110 is configured to detect dust or foreign substances flowing from the outside to the inside of the cleaner 100. The dust detection sensor 110 may include a light emitting element and a light receiving element. The light emitting element and the light receiving element may be disposed adjacent to each other. Also, one light emitting element can be arranged in a line between at least two light receiving elements. However, this is merely exemplary, and is not limited thereto. That is, the number and location of the light emitting element and the light receiving element may vary depending on the embodiment.

The light emitting element is an infrared optical sensor and may emit light. Specifically, the light emitting element may be disposed outside the dust container 14 in the direction of the inlet of the dust container 14, so that light can be emitted from the outside of the dust container 14 in the direction of the inlet of the dust container 14. The light emitted from the light emitting element can be reflected by the dust container 14 or dust or foreign substances in the dust container 14. The dust detection sensor 110 may be provided adjacent to the suction device 13, and the light emitted from the light emitting element may be reflected by the suction device 13 or dust flowing into the dust container 14 through the suction device 13.

The light receiving element may also receive light as an infrared light sensor. Specifically, the light receiving element may receive light emitted by the light emitting element after the emitted light is reflected. The light receiving element, similar to the light emitting element, may also be provided in the suction device 13 and disposed outside of the dust container 14 in the direction of the inlet of the dust container 14. Accordingly, the light receiving element can receive light reflected by the suction device 13 and dust inside the suction device 13, but also receive light reflected by the inside of the dust container 14 and the dust inside the dust container 14. The reflection area of light and the amount of reflected light per unit area may vary depending on the location where the light is reflected. Thus, the amount of light reaching the light receiving element may also vary depending on the location of the reflected light.

The light receiving element may output a voltage corresponding to the amount of received light. Since the amount of light reaching the light receiving element varies according to the reflection position of light emitted from the light emitting element, the magnitude of the voltage output from the light receiving element may vary depending on the reflection position of light emitted from the light emitting element.

For example, when the light receiving element receives light reflected by the dust suction device 13 or dust flowing into the dust container 14 through the suction device 13, the light receiving element can receive a larger amount of reflected light, as compared to when the light receiving element receives light reflected by the dust container 14 or dust in the dust container 14, in that the light receiving element is provided adjacent to the suction device 13. In this example, the light receiving element can output a high voltage based on the received light amount. When the light receiving element receives the light reflected by the dust container 14 or the dust in the dust container 14, the light receiving element can receive less light than when the light reflected in the suction device 13 is received, in that the distance between the light receiving element and the reflection position of the light is farther, as compared to when the light receiving element receives light reflected by the suction device 13 or dust flowing through the suction flow path of the suction device 13, causing the reflection area to be wide. In this example, the light receiving element can output a low voltage based on the received light amount.

The processor 120 may control overall operations and functions of the cleaner 100.

Based on the voltage value output from the light receiving element, the processor 120 can determine whether the dust is flown into the cleaner 100 and the amount of dust in the dust container 14. Specifically, the processor 120 can determine the dust amount and whether the dust is flown, based on an average of at least one voltage value outputted from the light receiving element within a predetermined time unit.

Specifically, the processor 120 may obtain a voltage value from the light receiving element every predetermined first time (e.g., 2 ms). The processor 120 may select some of the plurality of obtained voltage values for respective predetermined first time to calculate an average of at least one voltage value within a predetermined second time (e.g., 10 ms). The second time unit may include a first time unit. For example, the processor 120 may obtain, from the light receiving element, a voltage value corresponding to the amount of light received from the light receiving element every 2 ms, select five among the plurality of obtained voltage values for every 2 ms, and calculate an average of five voltage values within a unit of 10 ms.

The processor 120 may calculate an average of a plurality of voltage values every predetermined first time. The processor 120 may obtain a voltage value from the light receiving element at a predetermined first time, and at the same time, may calculate an average of the plurality of voltage values in the predetermined second time range using at least one voltage value obtained from the light receiving element before obtaining the voltage value.

According to an embodiment of the disclosure, when the voltage value obtained from the light receiving element corresponds to a predetermined range, the processor 120 may calculate an average of a plurality of voltage values within a predetermined second time unit. For example, the processor 120 can calculate an average of a plurality of voltage values obtained within a predetermined time unit only when the voltage value obtained from the light receiving element is 0.001V or more and 1V or less.

The processor 120 may determine the amount of dust in the dust container based on an average (hereinafter, average voltage value) of the voltage value output from the light receiving element in the predetermined time unit.

Figure 3:
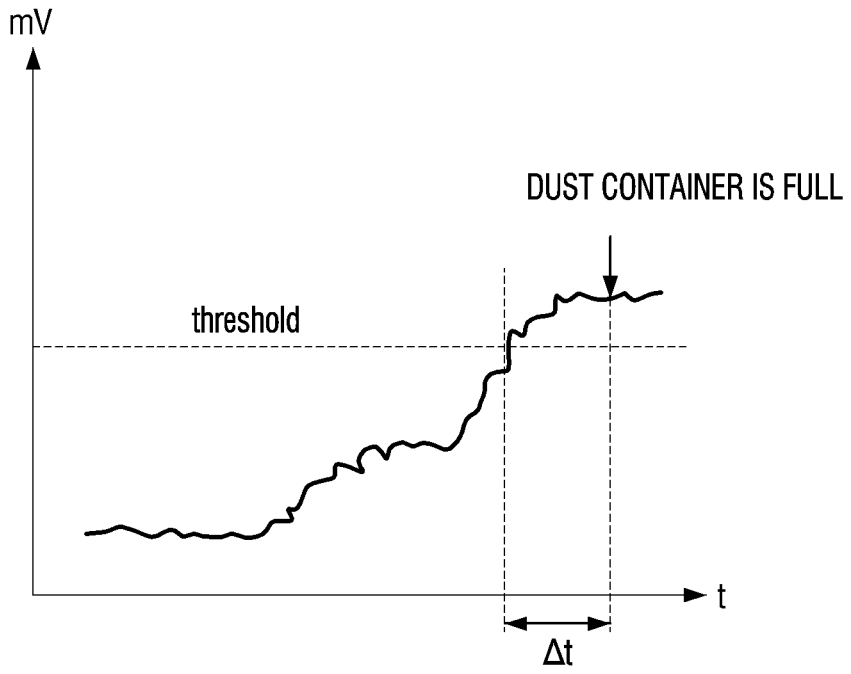
FIG. 3 is a diagram illustrating a cleaner for identifying a dust amount in a dust container according to an embodiment.

FIG. 3 is a diagram illustrating a cleaner for identifying a dust amount in a dust container according to an embodiment, and is a diagram illustrating a graph of an average voltage value over time.

As described above, the processor 120 may obtain an average (hereinafter, average voltage value) of the voltage value output from the light receiving element in a predetermined time unit (e.g., 10 ms) every predetermined time (e.g., 2 ms).

Figure 4:
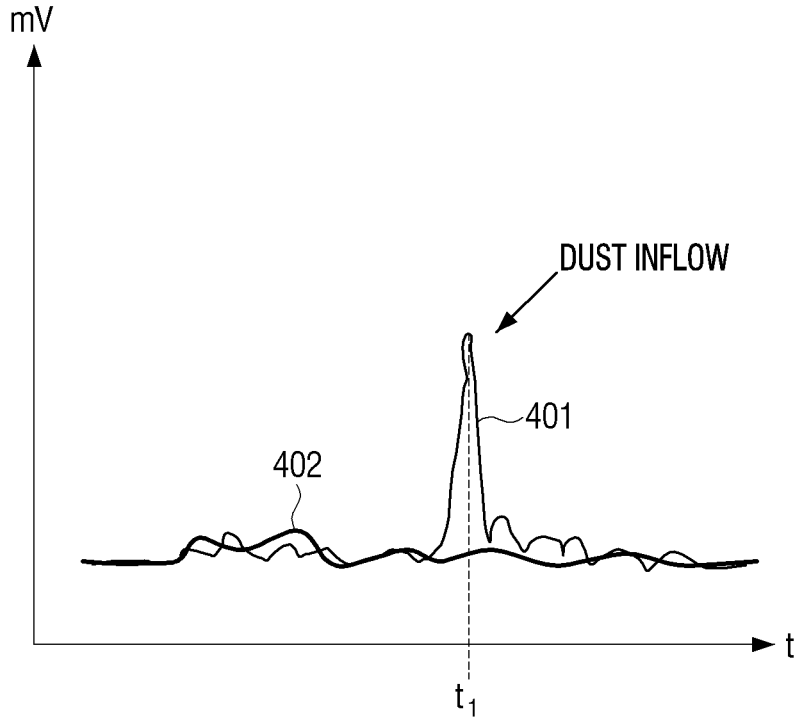
FIG. 4 is a diagram illustrating a cleaner for identifying dust inflow state according to an embodiment.

As the amount of dust in the dust container 14 increases, the dust inside the dust container is accumulated, and thus, a position at which the light emitted from the light emitting element is reflected into the dust container can be varied according to the amount of dust in the dust container 14. Specifically, when the dust amount of the dust container 14 is small, the light receiving element may receive the light reflected from the bottom surface of the dust container 14 or a position adjacent thereto, but in an example in which the amount of dust in the dust container 14 is large, the light receiving element can receive the light reflected from a position adjacent to the inlet of the dust container 14. That is, the more dust is accumulated in the dust container 14, the location at which light emitted from the light emitting device is reflected can be closer to the inlet of the dust container, and the amount of light received by the light receiving element can be increased. Accordingly, as the dust in the dust container 14 is accumulated, the voltage value output by the light receiving element increases. Also, as shown in FIG. 4, the average voltage value over time is also increased.

When the average of voltage value output from the light receiving element in a preset time unit, that is, average voltage value, is greater than or equal to a predetermined value, the processor 120 may determine that the dust amount of the dust container 14 is full.

When the average voltage value is greater than or equal to a predetermined threshold value for a predetermined time ($\Delta t$), the processor 120 may determine that the dust amount in the dust container 14 is full. The predetermined threshold value and the predetermined time are values that vary according to a capacity of the dust container 14 and may be determined variously according to experiments.

The processor 120 may identify whether dust is flown from the outside of the cleaner 100 to the dust container 14 using the calculated average voltage value.

FIG. 4 is a diagram illustrating a cleaner for identifying dust inflow state according to an embodiment.

As described above, in that the dust detection sensor 110 including the light emitting element and the light receiving element is provided at a position adjacent to the suction device 13, the light emitted from the light emitting element can be reflected by the dust inside the suction device 13 and received by the light receiving element. That is, the light receiving element can receive light reflected from the dust flowing into the dust container 12 through the suction device 13 in the cleaner 100, and the processor 120 can determine whether the dust is flowed into the cleaner 100 using the same.

As described above, the processor 120 may obtain a voltage value output from the light receiving element every predetermined first time unit and may calculate an average voltage value in a second time unit based on the obtained voltage value. The second time unit may include the first time unit.

A graph 401 of FIG. 4 illustrates the voltage value output from the light receiving element every predetermined first time unit, and a graph 402 illustrates an average voltage value calculated every predetermined first time unit.

The processor 120 may compare the average voltage value with the output voltage value and if the difference is greater than or equal to the predetermined first value, the processor 120 may determine the dust is flowed from the outside of the cleaner 100.

The processor 120 may obtain a voltage value output from the light receiving element at a time t1, and obtain an average voltage value based on at least one voltage value obtained from the light receiving element before the time t1. If the difference between the obtained voltage value and the average voltage value is greater than or equal to a predetermined first value, the processor 120 may determine that dust is flowed from the outside. The preset value denotes a value obtained by experimentation, and can be variously set according to the type of the cleaner.

According to an embodiment, a method of identifying whether dust is flowed into the cleaner (dust inflow state) and the amount of dust may be various.

For example, if the difference between the average voltage value and the output voltage value is greater than or equal to a predetermined first value, the processor 120 may identify whether the average voltage value is within a predetermined range. Specifically, if the difference between the average voltage value and the output voltage value is greater than or equal to a predetermined value, the processor 120 may identify whether the average voltage value is greater than or equal to a predetermined second value and less than a preset third value, and if the average voltage value corresponds thereto, the processor 120 may identify that the state is a dust inflow state. If the average voltage value exceeds the preset third value, the processor 120 can identify that the dust container 14 is in a full state, and if the average voltage value is less than the preset second value, the processor 120 can identify that the dust container 14 is in a separated state from the cleaner 100.

As described above, there may be various methods of identifying whether dust is flowed and a dust amount in a dust container using one sensor.

Referring back to FIG. 2, the processor 120 may control an operation of the cleaner 100 based on identified dust inflow state and dust amount.

The processor 120 may control the suction motor according to whether the dust is flowed. The processor 120, based on determination that dust is flowed from the outside of the cleaner 100 to the inside as a result of detection by the dust detection sensor 110, may control the suction motor 15 to increase suction force of the suction motor 15.

If it is identified that the cleaner 100 is power on state and dust is not flowed to the cleaner, the processor 120 can control the suction motor 15 so that the suction motor 15 operates in a normal mode. Here, the normal mode is one of the operation modes of the suction motor 15, and denotes a predetermined size (e.g., 150 air watt (AW)) of suction force.

The processor 120 can control the suction motor 15 so that the suction motor 15 operates in a turbo mode when it is identified that dust is flowed into the cleaner 100. In this example, the turbo mode is one of the operation modes of the suction motor 15, and is in a state of having a greater suction force than the suction force in the normal mode. For example, the suction force of the suction motor 15 in the normal mode may be 150 AW, while the suction force of the suction motor 15 in the turbo mode can be 180 AW.

That is, if it is identified that dust is not flowed into the cleaner, the processor 120 may control the suction motor 15 so that the suction force of the suction motor has a preset value (a value corresponding to the normal mode), and if it is identified that dust is flowed into the cleaner, the processor 120 may control the suction motor 15 to increase the suction force of the suction motor 15 to be greater than or equal to a predetermined value.

Accordingly, the cleaner 100 can control suction force of the suction motor 15 based on the dust inflow state and may reduce power consumption. This is merely exemplary, and if the processor 120 identifies that dust is flowed, the processor 120 may increase a rotation speed of the brush 12.

The processor 120 may control the operation of the dust sensor 110 based on the amount of dust in the dust container 14. If it is identified that the amount of dust in the dust container 14 is full, the processor 120 can stop the dust inflow detection operation of the dust detection sensor 110. The processor 120 may control a driving device (not shown) to move the cleaner 100 to a predetermined position. The predetermined position may refer to a station of the robot cleaner in which the battery of the robot cleaner is charged or the dust container of the robot cleaner is emptied. That is, if it is identified that the dust amount of the dust container 14 is full, the processor 120 can control the driving device (not shown) so that the cleaner 100 can move to the station.

The processor 120 may obtain capacity information of the battery from a power supply part (not shown). The capacity information of the battery may include a total capacity of a battery, a usable capacity of a battery, a usable time of a battery, or the like.

Based on the obtained capacity information of the battery, the processor 120 can identify the dust inflow state and the dust amount. If the available capacity of the battery exceeds a predetermined value, the processor 120 can identify whether dust is flowed into the cleaner 100 and the amount of dust in the dust container 14. That is, if the available capacity of the battery is less than or equal to a predetermined value, the processor 120 may not identify whether dust is flowed into the cleaner 100 and the amount of dust in the dust container 14. For example, if the cleaner is a robot cleaner and the available capacity of the battery is less than or equal to a predetermined value, the processor 120 can control the driving device (not shown) to stop the dust inflow state and the determination of the dust amount of the dust container 14, so that the cleaner may move to the station (not shown). In this example, the processor 120 may stop the operation of the brush 12 and the suction motor 15. When the cleaner 100 is moved to the station, the processor 120 can control a power supply unit (not shown) to charge the battery of the cleaner.

The processor 120 may identify an operation mode of the cleaner 100, and identify the dust inflow state and the dust amount of the dust container 14 only when the operation mode of the cleaner 100 is in a specific mode. Here, the operation mode of the cleaner 100 may include an automatic mode, a manual mode, a point cleaning mode, etc., which may vary depending on the type of the cleaner and the setting of the system. The automatic mode indicates a mode in which the cleaner detects dust while automatically operating without a user's manipulation, the manual mode indicates a mode in which the cleaner 100 operates according to the operation of the user, and the point cleaning mode indicates a mode in which the cleaner 100 automatically detects dust and sucks dust while moving at a specific area designated by the user.

Only when the operation mode of the cleaner 100 is an automatic mode, the processor 120 may identify the dust inflow state and the dust amount of the dust container 14, and when the operation mode of the cleaner 100 is a manual mode or other modes, the processor 120 may stop identifying the dust inflow state and the dust amount of the dust container 14.

The processor 120 can identify the dust inflow state and the dust amount of the dust container 14 based on whether cleaning of the cleaner is completed. Specifically, the processor 120 can identify whether cleaning of the cleaner is completed based on the movement information of the cleaner. Based on the accumulated movement information of the cleaner, the processor 120 can obtain the information of the area to be cleaned and store the information in a memory (not shown). The processor 120 can compare the obtained information about the cleanable area with the movement information of the cleaner to identify whether cleaning of the cleaner is completed. If it is identified that the cleaner has not completed cleaning, the processor 120 can identify the dust inflow state and the amount of dust in the dust container 14.

The processor 120 may control various elements of the cleaner 100.

Figure 5:
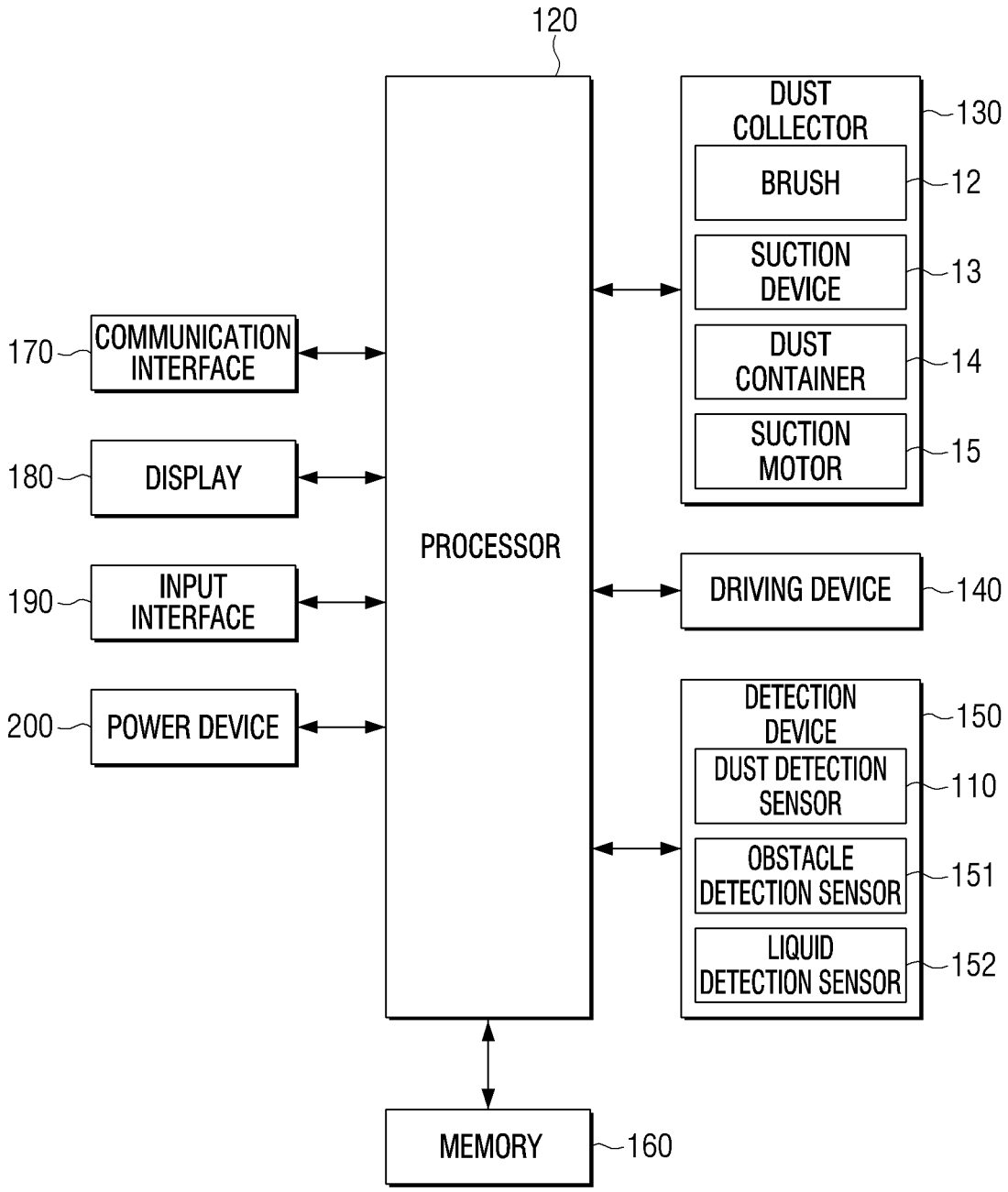
FIG. 5 is a block diagram illustrating a configuration of a cleaner in greater detail according to an embodiment.

FIG. 5 is a block diagram illustrating a configuration of a cleaner in greater detail according to an embodiment.

Referring to FIG. 5, the cleaner 100 according to various embodiments may include a dust collector 130, a driving device 140, a detection device 150, a memory 160, a communication interface 170, a display 180, an input interface 190, a power device 200, and the processor 120. The description of the processor 120 overlaps with the description in FIG. 2 and will be omitted.

The dust collector 130 collects dust existing outside the cleaner 100. As shown in FIG. 5, the dust collector 130 may include the brush 12, the suction device 13, the dust container 14, and the suction motor 15. A description of the brush 12, the suction device 13, the dust container 14, and the suction motor 15 will not be described in detail, as the description has been provided with reference to FIG. 2.

The driving device 140 is a component that moves the cleaner 100. The driving device 140 may include one or more wheels. In addition, the driving device 140 may include a driving motor for rotating the wheels according to the type of the cleaner. The driving device 140 may perform a driving operation, such as moving, stopping, turning, etc., according to a control signal of the processor 120.

The detection device 150 may include a sensor included in an operation of the cleaner 100. The detection device 150 may include the dust detection sensor 110 described in FIG. 2. The description of the dust detection sensor 110 has been provided with reference to FIG. 2 and will not be further described.

The detection device 150 may further include an obstacle detection sensor 151, a liquid detection sensor 152, and the like. The obstacle detection sensor 151 may detect a location of an obstacle around the cleaner 100 and a distance from the obstacle using an ultrasonic sensor, an infrared sensor, a radio frequency (RF) sensors, or the like. In addition, the obstacle detection sensor 151 may further include a collision sensor to detect an obstacle through a collision with the obstacle. The liquid detection sensor 152 may detect whether the cleaner 100 is in contact with liquid. In particular, the liquid detection sensor 152 may detect whether a liquid is in contact with the wheels constituting the driving device 140 of the cleaner 100.

The memory 160 may store various programs and data necessary for operation of the cleaner 100. The memory 160 may be implemented as a non-volatile memory, a volatile memory, a flash memory, a hard disk drive (HDD), or a solid state drive (SSD).

The memory 160 may store a plurality of voltage values obtained for each predetermined first time unit from the light receiving element. The processor 120 may calculate an average voltage value based on a plurality of voltage values stored in the memory 160.

The memory 160 may store map information generated according to the driving of the driving device 140. The map information may be in the form of an image and may be trajectory data in the form of coordinates, with information indicating the path of moving and the path of cleaning of the cleaner 100 during the cleaning process. Here, the moving path is the entire path of the cleaner 100, and the cleaning path refers to a path at which the dust suction operation is performed by the dust collector 130 among the entire path. The memory 160 may store history, or the like, generated during the cleaning process as history information. The history information may include a cleaning time, a charge frequency information, an error occurrence frequency information, respective error information, information about a non-cleaning area, or the like.

The communication interface 170 is configured to allow the cleaner 100 to communicate with an external device (not shown). Here, the external device (not shown) may be a user terminal device, a home server, or the like, but is not necessarily limited thereto. The cleaner 100 may provide cleaning result information to a user terminal device (not shown) through the communication interface 170, and may receive various commands related to the operation of the cleaner 100 from the user terminal device. The cleaning result information may denote information about the result of cleaning performed by the cleaner 100 and may include cleaning time, moving path, cleaning path, error information, non-cleaning area information, or the like.

The communication interface 170 may include various communication modules such as a wired communication module (not shown), near-field wireless communication module (not shown), wireless communication module (not shown), or the like.

The wired communication module is a module for performing communication with an external device (not shown) according to a wired communication method such as wired Ethernet. The near field communication module is a module for performing communication with an external terminal (not illustrated) positioned at a near distance through near field communication methods such as Bluetooth (BT), Bluetooth low energy (BLE), ZigBee, or the like. The wireless communication module is a module which communicates by being connected to an external network according to a wireless communication protocol, such as wireless fidelity (Wi-Fi), Institute of Electrical and Electronics Engineers (IEEE) and the like. The wireless communication module may further include a mobile communication module which is connected to a mobile communication network according to various mobile communication standards such as 3rd generation (3G), 3rd generation partnership project (3GPP), long term evolution (LTE), LTE advanced (LTE-A), 5th generation (5G) networks, or the like, to perform communications.

The display 180 may display various information supported by the cleaner 100. The display 180 may be a small-sized monitor, such as a liquid crystal display (LCD), and may be implemented as a touch screen capable of performing the functions of the input interface 190 to be described later.

The display 180 may display information such as an operating state of the robot cleaner 100 (the cleaning mode or the sleep mode), information related to the cleaning progress (e.g., a cleaning progressing time, a current cleaning mode (e.g., suction intensity)), battery information, charge status, whether the dust container is full of dust, an error condition (liquid contact state), or the like. The display 180 may then indicate the detected error if an error is detected.

The input interface 190 is a component that receives the user's input. The input interface 190 may include a plurality of function keys corresponding to the functions of the cleaner 100. The input interface 190 may be implemented as a plurality of buttons or the like, and may be implemented as a touch screen for simultaneously performing the functions of the display 180.

The input interface 190 may receive an on/off command of a function of the cleaner 100, a selection of a cleaning mode, a re-cleaning command for a cleaning area, a cleaning command for a specific space, or the like.

Figure 6:
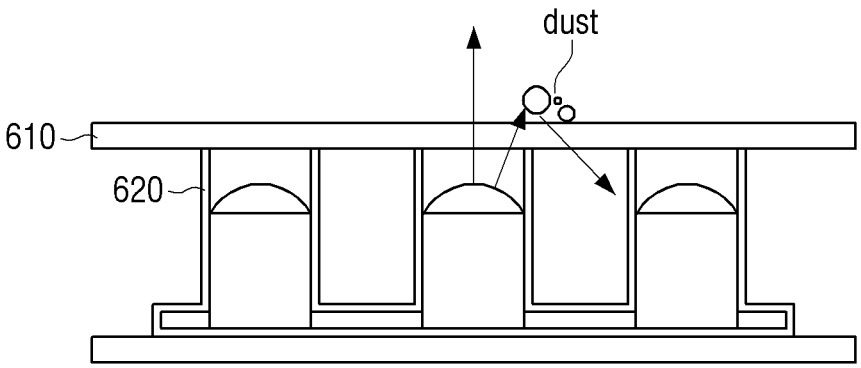
FIG. 6 is a diagram illustrating a structure of a dust detection sensor according to an embodiment.

A power supply 200 supplies power necessary for driving the cleaner 100. The power supply 200 may be electrically connected to various components of the cleaner 100, such as the dust collector 130, the driving device 140, and the like, to supply power. The power supply 200 may include a battery. The battery may be provided as a rechargeable secondary battery and may be charged with power from the station when the cleaner 100 completes operation and is coupled to a station (not shown). The power supply 200 may provide the processor 120 with information related to the battery, such as the capacity of the battery, the usable time of the battery, or the like. FIG. 6 illustrates a structure of a dust detection sensor according to an embodiment.

Referring to FIG. 6, the dust detection sensor 110 may include a transparent window 610 and a blocking rib 620.

The transparent window 610 is provided at an upper end of the light emitting element 612 and the light receiving element 614, that is, a side from which light is output and to which light enters, for passing light emitted from the light emitting element and light directed toward the light receiving element therethrough.

The transparent window 610 included in the dust detection sensor 110 prevents contamination of the light emitting element and the light receiving element by dust.

As illustrated in FIG. 6, internal reflection may occur due to dust attached to the transparent window 610. In this example, the light receiving element may receive the light reflected by the internal reflection, so that a dust inflow detection error can be generated.

To prevent this phenomenon, the light emitting element and the light receiving element may include a blocking rib 620. The blocking rib 620 surrounds a side portion of the light emitting element or the light receiving element so as to block the light emitted from the light emitting element from being reflected from the transparent window and being received by the light receiving element.

In order to avoid the internal reflection of the emitted light as much as possible, the blocking rib 620 may be provided adjacent to the transparent window 610 as much as possible. Specifically, as shown in FIG. 6, the blocking rib may surround the side portion of the light emitting element or the light receiving element so that the upper end of the blocking rib is in contact with the transparent window.

In that the internal reflection occurs due to the dust attached to the transparent window 610, the arrangement position of the dust detection sensor for reducing the dust attached to the transparent window 610 can be considered.

FIG. 7 is a diagram illustrating a location of a dust detection sensor according to an embodiment.

FIG. 7 illustrates a diagram illustrating a side view of the suction device 13 provided with the dust detection sensor 110.

Figure 7A:
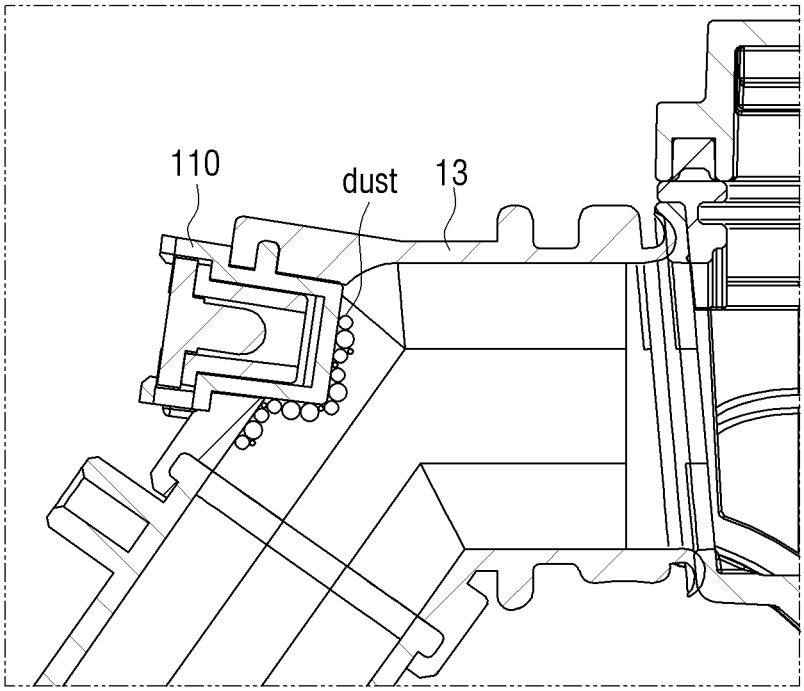
FIG. 7A is a diagram illustrating a location of a dust detection sensor according to an embodiment.

As illustrated in FIG. 7A, when the dust detection sensor 110 protrudes from the inner surface of the suction device 13, dust sucked from the outside can be accumulated in a space generated according to a step difference between the dust detection sensor 110 and the suction device 13. Accordingly, dust can be buried or accumulated in the transparent window 610 of the dust detection sensor 110, and thus the internal reflection problem described above can occur in FIG. 6.

Figure 7B:
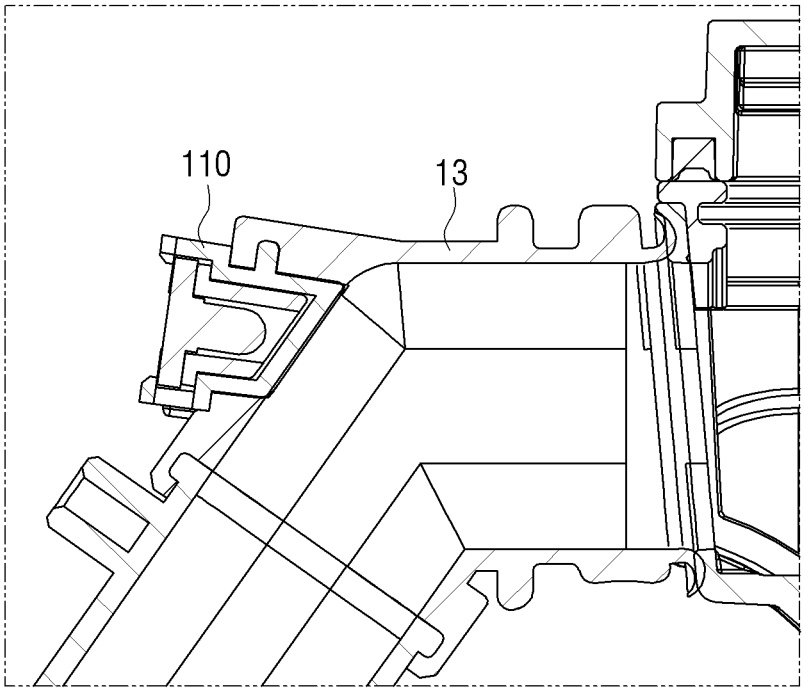
FIG. 7B is a diagram illustrating a location of a dust detection sensor according to an embodiment.

To prevent this, as shown in FIG. 7B, the transparent window 610 of the dust detection sensor 110 may be placed in the same line with one side of the suction device 13 so that a step difference is not generated between the dust detection sensor 110 and the suction device 13. Specifically, the dust detection sensor 110 may be provided so that the front surface of the transparent window 610 is placed in the same plane with the inner surface of the suction device 13. In other words, as can be seen from FIG. 7B, the transparent window 610 of the dust detection sensor 110 is flush with the inner surface of the suction device 13. In this example, dust is not accumulated around the dust sensor 110 in that there is no step difference between the dust sensor 110 and the suction device 13. That is, as shown in FIG. 7B, when both ends of the dust detection sensor 110 are placed on the extension line of the inner surface of the suction device 13 to prevent a step difference from occurring between the dust detection sensor 110 and the suction device 13 as shown in FIG. 7B, the detection error of the light receiving element due to the internal reflection of the light emitted from the light emitting element may be reduced.

Figure 8:
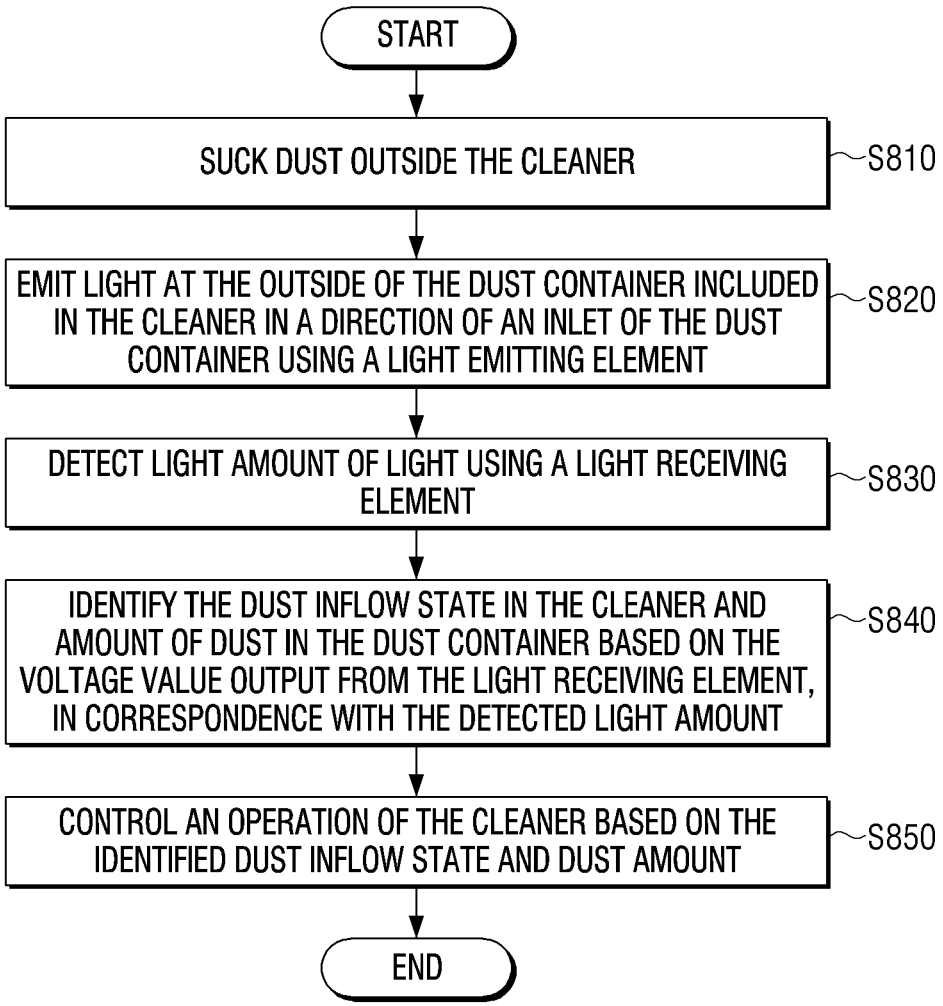
FIG. 8 is a flowchart illustrating a controlling method of a cleaner according to an embodiment.

FIG. 8 is a flowchart illustrating a controlling method of a cleaner according to an embodiment.

Referring to FIG. 8, dust outside the cleaner is sucked in operation S810. The dust sucked form the outside of the cleaner may be flowed to the dust container through the suction device.

In operation S820, light is emitted from the outside of the dust container included in the cleaner in a direction of the inlet of the dust container by using the light emitting device. At this time, the light emitting element may be provided at a position adjacent to the suction device and can be disposed outside the dust container in an inlet direction of the dust container. Therefore, the light emitted from the light emitting element can reach the inside of the dust container through the inlet of the dust container. Meanwhile, the light emitted from the light emitting element may be reflected from dust inside the dust container or dust inside the suction device.

In this example, light amount may be detected using a light receiving element disposed adjacent to the light emitting element in operation S830. The intensity of voltage output by the light receiving element may be decided according to the detected light amount.

The dust inflow state in the cleaner and amount of dust in the cleaner may be identified based on the voltage value output from the light receiving element, in correspondence with the detected light amount in operation S840. Specifically, the average of the voltage values output from the light receiving element within a predetermined time unit can be calculated, and the dust amount in the dust container and the dust inflow state can be identified based on the calculated average.

For example, if the average of the output voltage values is greater than or equal to a predetermined value, it may be identified that the amount of dust in the dust container is full. However, this is an embodiment, and if the average of the output voltage values is greater than or equal to a predetermined value for a predetermined period of time, it may be identified that the amount of dust in the dust container is full.

If the difference between the average of the voltage value output from the light receiving element and the voltage value output from the light receiving element is greater than or equal to a predetermined value in a predetermined time unit, it may be identified that dust is flowed from the outside. The process of identifying the dust inflow state and the dust amount of the dust container will be further described with reference to FIG. 9.

An operation of the cleaner may be controlled based on the identified dust inflow state and the dust amount in operation S850.

If it is identified that the dust amount of the dust container is full, the dust detection operation can be stopped and the cleaner can be moved to a predetermined position. Here, the predetermined position may be a station of the cleaner. That is, if it is identified that the dust amount of the dust container of the cleaner is full, the dust contained in the dust container of the cleaner can be emptied by moving the cleaner to the station of the cleaner.

If it is identified that dust is flowed, the suction force of the cleaner may be increased to be greater than or equal to a predetermined value. The predetermined value denotes a value corresponding to suction force when the cleaner does not suck dust, and may be a value corresponding to the suction force of the suction motor in a normal state.

The method of controlling a cleaner according to the disclosure may further include identifying an operation mode of the cleaner. Here, the operation mode of the cleaner may include an automatic mode, a manual mode, a point cleaning mode, or the like, which may vary depending on the type of the cleaner and the setting of the system. The automatic mode indicates a mode in which the cleaner 100 detects dust while automatically operating without the operation of a user, and the manual mode indicates a mode in which the cleaner 100 operates according to the operation of the user, and the point cleaning mode indicates a mode in which the cleaner 100 automatically senses dust and sucks dust while moving at a specific area designated by the user.

If the identified operation mode of the cleaner is a preset mode, it is possible to identify whether the dust is flowed in or not based on the voltage value obtained from the light receiving element. In this example, the preset mode refers to an automatic mode, that is, a mode in which the cleaner is automatically operated without the manipulation of a user and detects and sucks dust.

The controlling method of the cleaner according to an embodiment can obtain usable capacity information of a battery of the cleaner. If the obtained usable capacity of the battery is greater than or equal to a predetermined value, it is possible to identify dust inflow state and the dust amount in the dust container.

The controlling method of the cleaner according to another embodiment can obtain a moving path of the cleaner. It is possible to identify whether cleaning of the cleaner is completed based on the obtained moving path information of the cleaner. In this example, if it is identified that the cleaning of the cleaner is not completed, it is possible to identify the dust inflow state and the dust amount in the dust container.

Figure 9:
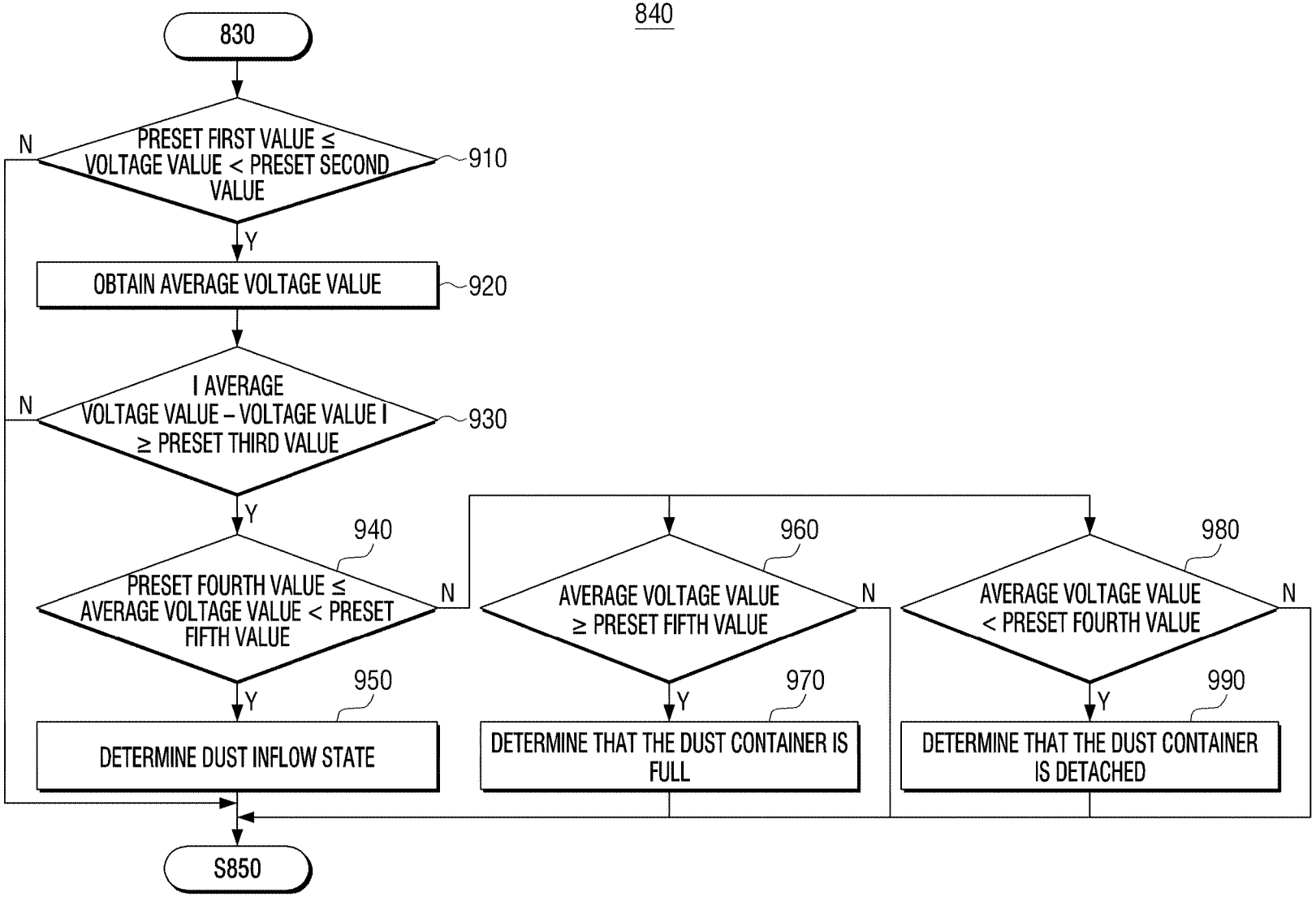
FIG. 9 is a flowchart illustrating a controlling method of a cleaner according to an embodiment.

FIG. 9 is a flowchart illustrating the step of S830 of FIG. 8 in greater detail.

The voltage value corresponding to the amount of light detected by the light receiving element may be obtained from the light receiving element and the obtained voltage value may be identified. It is identified whether the voltage value obtained from the light receiving element is equal to or greater than a predetermined first value or less than a predetermined second value in operation S910.

In operation S920, if the voltage value obtained from the light receiving element is greater than or equal to a predetermined first value and less than or equal to a second predetermined value, an average voltage value is obtained in operation S920. Here, the average voltage value may represent an average of the voltage values obtained from the light receiving element within a predetermined time range.

If the difference between the average voltage obtained in operation S920 and the voltage value obtained in step S910 is equal to or greater than the preset third value in operation S930-Y, the range of the average voltage value can be identified.

In this example, if the average voltage value is greater than or equal to the predetermined fourth value and less than the preset fifth value in operation S940-Y, the cleaner 100 can identify that the dust is flowing in.

If the average voltage value is equal to or greater than the preset fifth value in operation S960-Y, it can be identified that the dust container is full of dust in operation S970.

If the average voltage value is less than the preset fourth value in operation S980-Y, the dust container can be identified to be detached (or separated) from the cleaner in operation S990.

As described above, the controlling method of the cleaner according to the embodiment identifies whether dust flows into the cleaner or dust amount in the dust container by one sensor and thus, there is an effect of saving the manufacturing cost of the cleaner and reducing the volume and capacity of the cleaner.

The controlling method as described above may be implemented with a program that includes an executable algorithm that may be executed on a computer, and the program may be stored in a non-transitory computer readable medium.

The non-transitory computer readable medium refers to a medium that stores data semi-permanently rather than storing data for a very short time, such as a register, a cache, a memory or etc., and is readable by an apparatus. The aforementioned various applications or programs may be stored in the non-transitory computer readable medium, for example, a compact disc (CD), a digital versatile disc (DVD), a hard disc, a Blu-ray disc, a universal serial bus (USB), a memory card, a read only memory (ROM), and the like, and may be provided.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A cleaner comprising:

a suction device configured to suck dust from outside of the cleaner through a suction port of the cleaner, and having an inner surface forming a suction flow path in the suction device along which the sucked dust passes;

a dust container having an inlet, and configured so that the sucked dust passed along the suction flow path of the suction device to an end of the suction path then passes through the inlet to be stored in the dust container;

a dust detection sensor including a light emitting element, disposed outside of the suction flow path and the dust container, configured to emit light that passes through the suction flow path and the inlet of the dust container to be reflected inside the dust container, and light that passes through or to, the suction flow path to be reflected inside the suction device, and a light receiving element, disposed outside of the suction flow path and the dust container, configured to receive the light reflected inside the dust container and the light reflected inside the suction device, and to output voltage values based on the received light; and a processor configured to:

identify a dust inflow state and a dust amount of the dust container based on voltage values output by the light receiving element, and control an operation of the cleaner based on the identified dust inflow state and dust amount.

2. The cleaner of claim 1, wherein the processor is further configured to identify the dust amount of the dust container based on an average value of voltage values output by the light receiving element in a predetermined time unit.

3. The cleaner of claim 2, wherein the processor is further configured to, based on the average value of the voltage values being greater than or equal to a predetermined value, identify that the dust amount in the dust container is full.

4. The cleaner of claim 1, wherein the processor is further configured to, based on a difference between an average value of voltage values output by the light receiving element and a voltage value output by the light receiving element being greater than or equal to a predetermined value in a predetermined time unit, identify that the dust is flowed in from the outside of the cleaner.

5. The cleaner of claim 1, wherein the suction device includes a suction motor configured to cause the dust to be sucked to the dust container, and the processor is further configured to, based on inflow of the dust to the cleaner being identified, control the suction motor so that suction force of the suction motor is increased to a predetermined value or higher.

6. The cleaner of claim 3, further comprising:

a driving device configured to move the cleaner, wherein the processor is further configured to, based on identification that the dust amount of the dust container is full, stop a dust inflow detection operation and control the driving device to move the cleaner to a station of the cleaner.

7. The cleaner of claim 1, further comprising:

wherein the dust detection sensor comprises a transparent window through which the light emitted by the light emitting element passes, and through which the light reflected inside the dust container and the light reflected inside the suction device passes, wherein a front surface of the transparent window is flush with the inner surface of the suction device.

8. The cleaner of claim 7, wherein the dust detection sensor further includes:

a blocking rib that surrounds a side portion of the light emitting element or the light receiving element, and that is configured to block light emitted by the light emitting element and reflected by the transparent window from being received by the light receiving element.

9. The cleaner of claim 8, wherein the blocking rib surrounds the side portion of the light emitting element or the light receiving element in a state where an upper end of the blocking rib is in contact with the transparent window.

10. The cleaner of claim 1, wherein the processor is further configured to, based on an operation mode of the cleaner being a mode in which the cleaner automatically operates without a user's manipulation, identify the dust inflow state and the dust amount in the dust container based on the voltage values output by the light receiving element.

11. The cleaner of claim 1, wherein the processor is further configured to obtain information about usable capacity of a battery of the cleaner and, based on the obtained information indicating that the usable capacity of the battery is greater than or equal to a predetermined value, identify the dust inflow state and the dust amount in the dust container.

12. The cleaner of claim 1, wherein the processor is further configured to:

identify whether cleaning of the cleaner is completed based on information about a moving path of the cleaner, and based on identification that the cleaning by the cleaner is not completed, identify the dust inflow state and the dust amount in the dust container.

13. A method comprising:

sucking dust outside a cleaner through a suction port of the cleaner by a suction device of the cleaner so that the sucked dust passes along a suction flow path formed by an inner surface of the suction device to an end of the suction path and then through an inlet of a dust container of the cleaner to be stored in the dust container;

emitting light from a light emitting element, disposed outside of the suction flow path and the dust container, of a dust detection sensor of the cleaner, that passes through the suction flow path and the inlet of the dust container to be reflected inside the dust container, emitting light from the light emitting element that passes through, or to, the suction flow path to be reflected inside the suction device;

receiving, by a light receiving element, disposed outside of the suction flow path and the dust container, of the dust detection sensor, the light reflected inside the dust container and the light reflected inside the suction device;

outputting, by the light receiving element, voltage values based on the received light;

identifying a dust inflow state and a dust amount in the dust container based on voltage values output by the light receiving element; and controlling an operation of the cleaner based on the identified dust inflow state and the dust amount.

14. The method of claim 13, wherein the identifying comprises:

calculating an average value of voltage values output by the light receiving element in a predetermined time unit; and identifying the dust amount in the dust container based on the calculated average value.

15. The method of claim 14, wherein the identifying the dust amount comprises, based on the average value of the voltage values being greater than or equal to a predetermined value, identifying that the dust amount in the dust container is full, and based on identifying that the dust amount of the dust container is full, stopping a dust inflow detection operation and moving a body of the cleaner that includes the suction device and the dust container to a station of the cleaner.

16. The method of claim 13, wherein the identifying comprises:

calculating an average value of voltage values output by the light receiving element in a predetermined time unit; and based on a difference between the average value and a voltage value output by the light receiving element being greater than or equal to a predetermined value in a predetermined time unit, identifying that the dust flows in from outside.

17. The method of claim 13, further comprising:

based on dust inflow to the cleaner being determined, increasing a suction force of the cleaner to a preset value or higher.

18. The method of claim 13, further comprising:

identifying an operation mode of the cleaner, wherein the identifying the dust inflow state and the dust amount in the dust container further comprises:

based on the identified operation mode of the cleaner being a mode in which the cleaner automatically operates without a user's manipulation, identifying the dust inflow state and the dust amount in the dust container based on the voltage values output by the light receiving element.

19. The method of claim 13, further comprising:

obtaining information about usable capacity of a battery of the cleaner, wherein the identifying the dust inflow state and the dust amount in the dust container further comprises, based on the obtained information indicating that the usable capacity of the battery is greater than or equal to a predetermined value, identifying the dust inflow state and the dust amount in the dust container.

20. A cleaner comprising:

a suction device configured to suck dust from outside of the cleaner through a suction port of the cleaner, and having an inner surface forming a suction flow path in the suction device along which the sucked dust passes;

a dust container having an inlet, and configured so that the sucked dust passed along the suction flow path of the suction device to an end of the suction path then passes through the inlet to be stored in the dust container;

a dust detection sensor disposed outside the suction flow path and the dust container, and configured to emit light that passes through the suction flow path and the inlet of the dust container to be reflected from a reflection position inside the dust container, and light that passes through, or to, the suction flow path to be reflected from a reflection position inside the suction device, and receive the light reflected from the reflection position inside the dust container and the light reflected from the reflection position inside the suction device, and to output voltage values based on the received light, wherein the dust detection sensor is disposed so that a distance from the reflection position inside the dust container to the dust detection sensor is farther than a distance from the reflection position inside the suction device to the dust detection sensor; and a processor configured to:

identify a dust inflow state and a dust amount of the dust container based on the voltage values output by the dust detection sensor, and control an operation of the cleaner based on the identified dust inflow state and dust amount.

* * * * *